US007242377B2

(12) United States Patent
Mori

(10) Patent No.: US 7,242,377 B2
(45) Date of Patent: Jul. 10, 2007

(54) IMAGE DISPLAY DEVICE

(75) Inventor: Makiko Mori, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 736 days.

(21) Appl. No.: 10/787,084

(22) Filed: Feb. 27, 2004

(65) Prior Publication Data

US 2004/0189626 A1 Sep. 30, 2004

(30) Foreign Application Priority Data

Feb. 28, 2003 (JP) ..... 2003-053381

(51) Int. Cl.
*G09G 3/30* (2006.01)
*G09G 5/00* (2006.01)

(52) U.S. Cl. ..... 345/77; 345/204

(58) Field of Classification Search ..... 345/77, 345/87, 98, 100, 204; 348/673, 374
See application file for complete search history.

(56) References Cited

U.S. PATENT DOCUMENTS

| | | | | |
|---|---|---|---|---|
| 5,757,343 | A | 5/1998 | Nagakubo | 345/63 |
| 5,995,072 | A * | 11/1999 | Nakajima | 345/87 |
| 6,570,611 | B1 * | 5/2003 | Satou et al. | 348/674 |
| 6,603,104 | B1 | 8/2003 | Lee | 250/205 |
| 6,654,028 | B1 | 11/2003 | Yamakawa | 345/690 |
| 6,778,182 | B2 | 8/2004 | Yamakawa | 345/589 |
| 6,982,704 | B2 * | 1/2006 | Aoki et al. | 345/204 |
| 2001/0035850 | A1 | 11/2001 | Okamoto et al. | 345/77 |
| 2002/0033830 | A1 | 3/2002 | Yamakawa | 345/600 |
| 2003/0025718 | A1 | 2/2003 | Mori | 345/690 |

FOREIGN PATENT DOCUMENTS

| | | |
|---|---|---|
| JP | 11-205633 | 7/1999 |
| JP | 11-327496 | 11/1999 |
| JP | 2000-221941 | 8/2000 |
| JP | 2000-250463 | 9/2000 |
| JP | 2001-154643 | 6/2001 |
| JP | 2001-296855 | 10/2001 |
| JP | 2002-44681 | 2/2002 |
| JP | 2003-15582 | 1/2003 |

* cited by examiner

*Primary Examiner*—Kevin M Nguyen
(74) *Attorney, Agent, or Firm*—Fitzpatrick, Cella, Harper & Scinto

(57) ABSTRACT

This invention relates to an image display device having: an adjusting circuit that adjusts image signals to be inputted based on an adjusting value to be sequentially up-to-dated; a non-linear converting circuit at a stage after the adjusting circuit, the non-linear converting circuit that converts inputted signals into signals in a non-linear manner, a display brightness characteristics value detecting circuit at a stage after the non-linear converting circuit, the display brightness characteristics value detecting circuit that sequentially detects a display brightness characteristics value that is directed to lightness of a display image from the inputted signals; a brightness refraining value outputting circuit that sequentially outputs a brightness refraining value that refrains lightness of the display image based on the display brightness characteristics value; and an adjusting value outputting circuit that applies conversion having characteristics being inverse with relative to a converting characteristics of the non-linear converting circuit or conversion being approximate to the former conversion, to the brightness refraining value to output the adjusting value.

19 Claims, 14 Drawing Sheets

FIG. 11

| CONFIGURATION / INVERSE-$\gamma$ | CONVENTIONAL CONFIGULATION | THE PRESENT CONFIGULATION |
|---|---|---|
| POWER OF 2.2 | 15BIT | 15BIT |
| EQUATION 6 | 12BIT | 11BIT |

IMAGE DISPLAY DEVICE

BACKGROUND OF THE INVENTION

The present invention relates to an image display device.

An image display device is known that has an ABL circuit and a contrast adjusting circuit. Especially, the ABL circuit is known that performs control process so that an average display brightness of a screen does not become too large for convergence of beams, or so as to refrain a consumption electric power and the like.

For example, Japanese Patent Laid-open application No. 2000-221941 discloses a configuration that performs the ABL, in which an automatic brightness control circuit is used, and also a brightness level is adjusted for pixel data by each of pixels of an image to be sequentially supplied from an A/D converter so that an average brightness of the image displayed on a screen of PDP lies within a predetermined range. Here the brightness level is adjusted before each of ratio between emission numbers of each of sub-fields is set in a non-linear manner and an inverse-γ conversion is performed.

Generally, an image signal is transmitted or recorded after following γ conversion under an assumption that the image signals are displayed using a CRT display device as illustrated in FIG. 12. The γ conversion allows the image signals to be non-linearly converted such as converted by power of 0.45 corresponding to input-emission characteristics of the CRT display device. When such image signals are displayed on a display device such as SED, FED or PDP having linear input-emission characteristics, an inverse-γ conversion serving as conversion represented by power of 2.2 as illustrated in FIG. 13 is needed for inputted signals. On the other hand, when inputted signals are displayed on a display device such as LCD, an appropriate conversion is performed that meets the characteristics of such a display device.

FIG. 14 shows a block diagram of an image signal processing device to be provided in a normal image display device having luminescence characteristics being different from luminescence characteristics of CRT for inputted signals such as SED, FED, PDP or LCD. An actual image signal processing device has many other processing circuits. However, in FIG. 14, only circuit blocks are picked up relating to the present invention.

An image signal processing device illustrated in FIG. 14 is provided with an A/D converter 1001, a signal processing section 1002, an average brightness detecting section 1003 and a gain calculating section 1004. The A/D converter 1001 inputs analog inputted image signals s101 and outputs digital image signals s102. The signal processing section 1002 inputs the digital image signal s102 and performs signal processing such as inverse-γ conversion, brightness/chromaticity-adjustment or a contour emphasis processing and thereafter outputs display signals s103. The average brightness detecting section 1003 inputs the digital image signals s102, detects an average brightness of each of frames, and thereafter outputs an average brightness control signals s104. The gain calculating section 1004 inputs an average brightness signal s104 and outputs a brightness control signal s105.

The A/D converter 1001, the signal processing section 1002, the average brightness detecting section 1003 and the gain calculating section 1004 are operated based on various timing signals generating according to a synchronous signal of the input image signals s101.

However in the configuration of FIG. 14, the average brightness can be obtained by summing up the digital image signals s102 while an actual image displayed using a display device is formed using display signals s103 that are signal-processed by various process manners, in which the inverse-γ conversion is typical. Especially, through the inverse-γ conversion, non-linear conversion like conversion of power of 2.2 as illustrated in FIG. 13 is performed. As a result, the average brightness is more lowered and also there is no one-to-one relationship between the average brightness of the digital image signal s102 and the average brightness of the display signal s103 processed by the inverse-γ conversion. Therefore the average brightness signal s104 to be detected by the average brightness detecting section 1003 has an error with relative to the average brightness to be actually displayed on the display device, resulting in that accurate average brightness information has not been able to be obtained.

SUMMARY OF THE INVENTION

The present invention is established in order to overcome the above-mentioned problems of the conventional art. The object is for accurately adjusting image signals in a configuration that performs non-linear conversion.

A first present invention is defined as follows:

An image display device has an adjusting circuit that adjusts image signals to be inputted based on an adjusting value to be sequentially up-to-dated; a non-linear converting circuit at a stage after the adjusting circuit, the non-linear converting circuit that converts inputted signals into signals in a non-linear manner; a display brightness characteristics value detecting circuit at a stage after the non-linear converting circuit, the display brightness characteristics value detecting circuit that sequentially detects a display brightness characteristics value indicating lightness of a display image from the inputted signals; a brightness refraining value outputting circuit that sequentially outputs a brightness refraining value that refrains lightness of the display image based on the display brightness characteristics value; and an adjusting value outputting circuit that applies a conversion having characteristics being inverse with relative to a converting characteristics of the non-linear converting circuit or conversion having characteristics approximate to the inverse characteristics, to the brightness refraining value to output the adjusting value

DESCRIPTION OF THE DRAWINGS

FIG. 11 is a comparison table of the scales of the circuits.

DETAILED DESCRIPTION OF THE INVENTION

Figure 1:
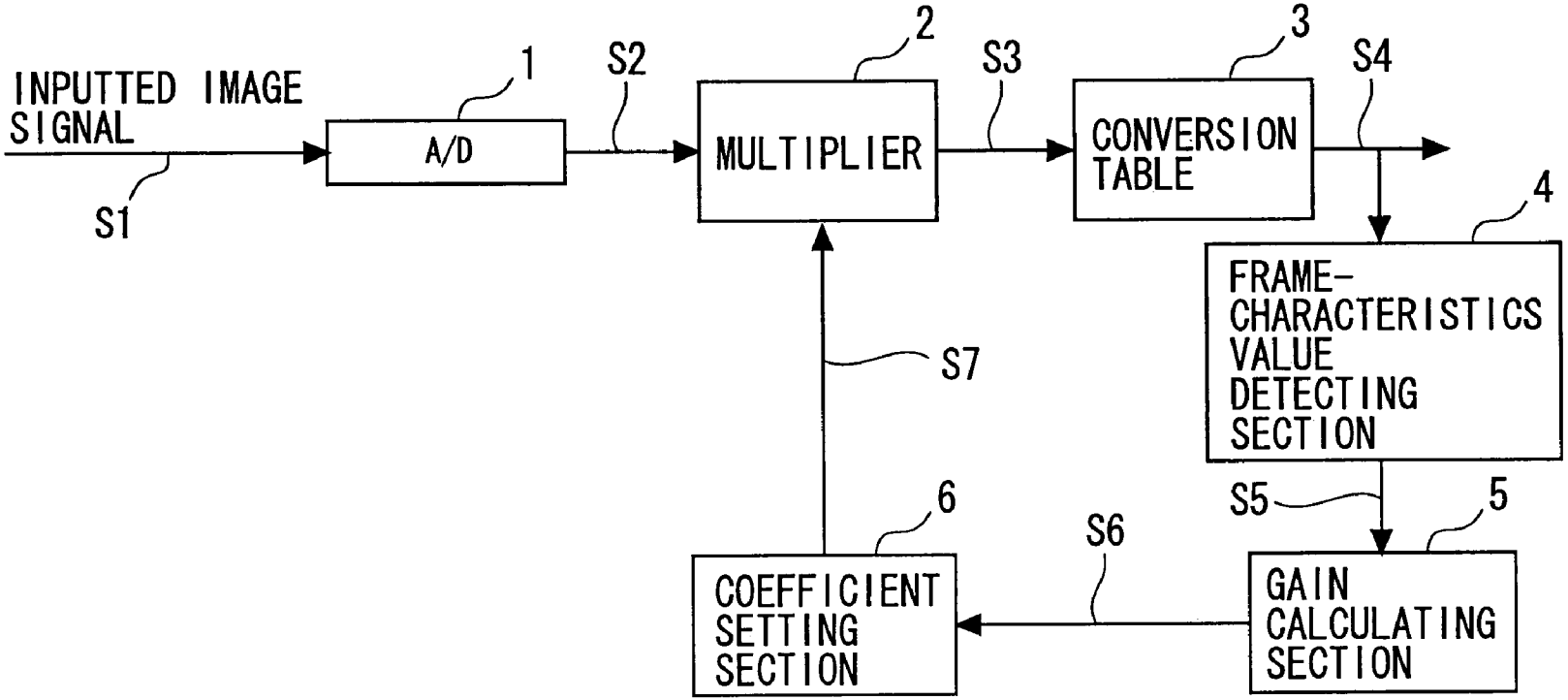
FIG. 1 is a block diagram for explaining about the configuration of the first aspect of the invention.

The term "brightness" is used regarding the invention in the present application. Here this term is also used as a term when a configuration for realizing a gradation display is employed by visually adding brightness for a predetermined term (modulating this term in a case of a pulse width modulation) like a case of displaying an image using a pulse width modulation method.

Note that in the present invention, an output of a non-linear converting circuit is inputted to an adjusting circuit as an input signal, on the other hand there is no necessity that the output from the non-linear converting circuit is directly inputted thereto. Namely, the output therefrom is indirectly inputted thereto by way of any other circuits (e.g., a circuit for performing a desired calculation if necessary).

Various configurations can be applied thereto as preferable aspects of the first invention A second invention is defined as follows.

An image display device has a multiplying circuit that outputs output signals obtained by multiplying inputted signals and a variable coefficient; a non-linear converting circuit at a stage after the multiplying circuit, the non-linear converting circuit that applies a non-linear conversion of power of γ (γ>1) or a conversion being approximate to the non-linear conversion thereto to inputted signals to output the converted signals; and a display brightness characteristics value detecting circuit at a stage after the non-linear converting circuit, the display brightness characteristics value detecting circuit that detects a display brightness characteristics value indicating lightness of display image from inputted signal; wherein a first value which is γ-th power root of a calculated value G that is sequentially up-to-dated or a second value approximate to the first value is used as the variable coefficient, and regarding as the calculated value G, if the display brightness characteristics value is defined by B, a calculated value before up-to-dated (updating) is defined by G0, and a reference value compared with the display. brightness characteristics value is defined by B0, then a relationship of $G=G0\times B0/B$ is satisfied.

A third invention is defined as follows.

An image display device according to the second invention is in that if the value of $G0\times B0/B$ is more than 1, then 1 is set as the calculated value G.

A fourth invention is defined as follows.

An image display device has a multiplying circuit that outputs output signals obtained by multiplying inputted signals and a variable coefficient; a non-linear converting circuit at a stage after the multiplying circuit, the non-linear converting circuit that applies a non-linear conversion of power of γ (γ>1) or a conversion being approximate to the non-linear conversion to inputted signals to output the converted signals; and a display brightness characteristics value detecting circuit at a stage after the non-linear converting circuit, the display brightness characteristics value detecting circuit that detects a display brightness characteristics value indicating lightness of display image from inputted signal; wherein the variable coefficient is a first value which is the γ-th power root of a calculated value G that is sequentially up-to-dated or a second value approximate to the first value, or a value obtained by modifying a high frequency component of a first value which is the γ-th power-root of a calculated value G that is sequentially up-to-dated or the second value approximate to the first value, and the calculated value G is any of (i) the display brightness characteristics value, or (ii) a value of $G0\times B0/B$ if a value obtained by modifying a high frequency component of a plurality of the display brightness characteristics value that is sequentially detected from the input signals is defined by B and a calculated value before updating is defined by G0 and a reference value that is compared with the display brightness characteristics value is defined by B0 or (iii) a value obtained by modifying a high frequency component of $G0\times B0/B$ to be sequentially obtained or (iv) a value of of $K0^{\gamma}\times B0/B$ if a variable coefficient before updating is defined by K0.

A fifth invention is defined as follows.

The image display device according to the fourth invention is in that 1 is set as the calculated value G if a value used as the calculated value G, among (i) the value of $G0\times B0/B$, (ii) the value obtained by modifying a high frequency component of $G0\times B0/B$ to be sequentially obtained and (iii) the value of $K0^{\gamma}\times B0/B$, is more than 1 if the variable coefficient before updating is defined by K0.

A sixth invention is defined as follows.

An image display device has an adjusting circuit that adjusts inputted image signals based on an adjusting value to be sequentially up-to-dated; a non-linear converting circuit at a stage after the adjusting circuit, the non-linear converting circuit that converts inputted signals into signals in a non-linear manner; a display brightness characteristics value detecting circuit at a stage after the non-linear converting circuit, the display brightness characteristics value detecting circuit that sequentially detects a display brightness characteristics value indicating lightness of display image from inputted signals; a brightness refraining value outputting circuit that sequentially outputs a brightness refraining value that refrains the lightness of the display image based on the display brightness characteristic value and a brightness control value related to an image quality adjustment; and an adjusting value outputting circuit that applies a first conversion having characteristic being inversed with relative to conversion characteristics of the non-linear converting circuit for the brightness refraining value or a conversion having characteristics being approximate to the first conversion to output the adjusting value.

A seventh invention is defined as follows.

An image display device has: an adjusting circuit that adjusts inputted image signals based on an adjusting value to be sequentially up-to-dated; a non-linear converting circuit at a stage after the adjusting circuit, the non-linear converting circuit that converts inputted signals into signals in a non-linear manner; a display brightness characteristics value detecting circuit at a stage after the non-linear converting circuit, the display brightness characteristics value detecting circuit that sequentially detects a display brightness characteristics value indicating lightness of display image from inputted signals; a brightness refraining value outputting circuit that sequentially outputs a brightness refraining value that refrains the lightness of the display image based on the display brightness characteristic value; and an adjusting value outputting circuit that outputs the adjusting value based on a value obtained by applying a first conversion having characteristic being inversed with relative to conversion characteristics of the non-linear converting circuit for the brightness refraining value or a conversion having characteristic being approximate to the inverse characteristics, and a brightness control value relating to an image quality adjustment.

An eighth invention is defined as follows.

The image display device according to any of the first to seventh inventions is in that the display brightness characteristics value is a total sum or an average value of display signals for a predetermined term.

A ninth invention is defined as follows.

The image display device according to any of the first to seven inventions is in that the display brightness characteristics value is the number of signals over a predetermined value of display signals for a predetermined term.

A tenth invention is defined as follows.

The image display device according to any of the first to seven inventions is in that the display brightness characteristics value is a total sum or an average value of kinds of colors of display signals for a predetermined term.

An eleventh invention is defined as follows.

The image display device according to any of the first to seven inventions is in that the display brightness characteristics value is a total sum or an average value of brightness components of display signals for a predetermined term.

A twelfth invention is defined as follows.

The image display device according to any of the first to seventh inventions is in that the display brightness characteristics value is a static value of display signals in a specified area in a screen.

A thirteenth invention is defined as follows.

The image display device according to any of the first to twelfth inventions is in that conversion characteristics of the non-linear converting circuit is a function having characteristics so as to be approximate to characteristics of equation of $g(x)=x^{\gamma}$ (x: inputted signal, g(x): output signal) over all the inputted area and a function having characteristics so that an output becomes larger than a value obtained by the equation of $g(x)=x^{\gamma}$ in a lower gradation section.

A fourteenth invention is defined as follows.

The image display device according to the thirteenth invention is in that conversion characteristics of the non-linear converting circuit represented by equations of:

$$g(x)=a*x(x\leqq 0),$$

$$g(x)=(1-z)x^{\gamma}+z(x>x0)$$

(x: inputted signal, g(x): output signal, a, z, γ and x0: constant values).

A fifteenth invention is defined as follows.

The image display device according to the thirteenth or fourteenth invention is in that the adjusting value is a value which is the γ-th power root of the brightness refraining value.

A sixteenth invention is defined as follows.

The image display device according to any of the first to fifteenth inventions further has a character information combining circuit for overlapping character information over the image signal, wherein the adjusting circuit, the non-linear converting circuit, the character information combining circuit and the display brightness characteristics detecting circuit are arranged orderly.

A seventeenth invention is defined as follows.

The image display device according to any of first to sixteenth inventions is in that pixels of the image display device are constituted by electron emission elements arranged in a matrix manner.

An eighteenth invention is defined as follows.

The image display device according to the seventeenth invention is in that the electron emission elements are surface conduction type electron emission elements.

A nineteenth invention is defined as follows.

The image display device according to the seventeenth or eighteenth invention is in that the display brightness characteristics value is an emitted current value to be emitted from the electron emission elements.

Note that though the display brightness characteristics value detecting circuit is arranged at a stage after the non-linear converting circuit, the meaning that the display brightness characteristics value detecting circuit is arranged at a stage after the non-linear converting circuit is defined by that signals that utilizes a result converted by the non-linear converting circuit are inputted to the display brightness characteristics value detecting circuit as inputted signals. Concretely speaking, a configuration can be adopted that output of the non-linear converting circuit is directly or indirectly inputted to the display brightness characteristics value detecting circuit, or a configuration can be adopted that signals obtained as a result of display based on the output of the non-linear converting circuit is inputted to the display brightness characteristics value detecting circuit as input signals. As the latter configuration, e.g., a configuration can be preferably adopted such that an electron emission element is adopted as a display element, in which an emitted current value obtained as a result that the electron emission element is driven based on the output of the non-linear converting circuit is detected, and the display brightness characteristics value is outputted as input signals by regarding the detected result as inputted signals for the display brightness characteristics value detecting circuit. As the latter configuration, e.g., a configuration can be preferably such that an electron emission element is adopted as a display element, an emitted current value obtained as a result that the electron emission element is driven based on the output of the non-linear converting circuit, and the display brightness characteristics value is outputted by regarding the detected result as inputting signals for the display brightness characteristics value detecting circuit. For example, the emitted current value can be detected as an amount of current when electrons emitted from the electron emission element are incident on an electrode to which a potential for accelerating electrons to be released from the electron emission element is supplied. Further, not only an emission current value from the electron emission element is detected but also the result obtained by detecting the value of current that flows through the display element can be employed as input signals for the display brightness characteristics value detecting circuit.

Note that though each of the circuits constituting the present invention is explained in the above and below descriptions, the circuits can be constituted using one or plural elements such as transistor(s) and resistor(s). The circuits can be integrated and namely realized as an integrated circuit.

Hereinafter, description will be explained about the present invention based on the illustrated aspects of the present invention.

(First Aspect)

FIG. 1 illustrates a main portion configuration of an image signal processing device 100 to be applied to an image display device of a first aspect of the present invention. FIG. 1 shows only block parts corresponding to FIG. 14.

(Main Configuration of the Image Signal Processing Device)

The image signal processing apparatus 100 is provided with an A/D converter 1, a multiplier 2, a conversion table 3, a frame characteristics value detecting section 4, a gain calculating section 5, and a coefficient setting section 6 as illustrated in FIG. 1.

The A/D converter 1 converts inputted image signals s1 into digital image signals s2. Here the image signals s1 are defined by signals corresponded to primary colors of the applied display device such as RGB. When the image signals s1 are brightness/color-difference signals, the signals s1 are converted to primary color signals using unillustrated color matrix. The multiplier 2 as an adjusting circuit multiplies a digital image signals s2 to be outputted from the A/D converter 1 by a coefficient s7 to be set from the after-mentioned coefficient setting section 6. The conversion table 3 as a non-linear converting circuit is constituted by memories such as ROMs and RAMs. The signal s3 to be outputted from the multiplier 2 is regarded as input data. The input data are made to be corresponded to addresses of the memories The converted results are stored as data corresponding to each of the addresses and thereby outputting the display signal s4. A conversion characteristics of the conversion table 3 is used that is as same as that in FIG. 13. The frame characteristics value detecting section 4 as a display brightness characteristics value detecting circuit inputs the display signal s4 and detects an average value of each of frames to output an average brightness signal s5 as a display brightness characteristics value. The gain calculating section 5 as a brightness refrain value outputting circuit inputs the average brightness signal s5 and compares the signal s5 with a predetermined brightness reference value, so that if the average brightness is over the brightness reference value, a gain (brightness refrain value) s6 such as refraining brightness is calculated and outputted. The coefficient setting section 6 as an adjusting value outputting circuit inputs the gain s6 and applies inverse conversion with relative to conversion characteristics of the conversion table 3 to the gain s6 and outputs a coefficient (adjusting value) s7 to be set in the multiplier 2.

The A/D converter 1, the multiplier 2, the conversion table 3, the frame characteristics value detecting section 4, the gain calculating section 5, and the coefficient setting section 6 are operated based on various timing signals in which each of corresponding unillustrated timing control sections generates based on the synchronous signal of the inputted image signals s1.

(Image Signal Processing Method)

Hereinafter, description will be explained about an image signal processing device 100 and also together with a method of calculating a coefficient by the coefficient setting section 6.

If an average brightness between the instant frames detected by the frame characteristics value detecting section 4 is defined by B(t) and a predetermined brightness reference value is defined by B0, a gain G(t) is obtained using following equation 1.

$$G(t)=\mathrm{MIN}(G(t-1)\times B_0/B(t),\ 1) \qquad \text{[Equation 1]}$$

Herein, G(t-1) is a gain before-outputted while MIN(a, b) is a function that can return any smaller value between "a" and "b".

Figure 13:
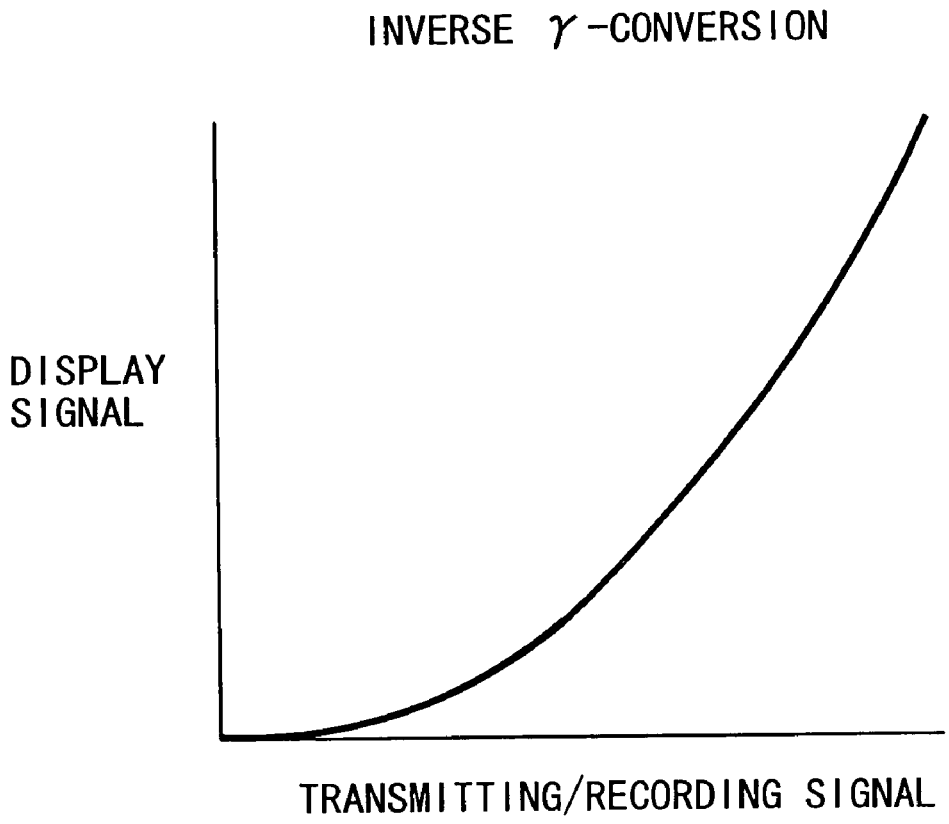
FIG. 13 is a graph for explaining about the inverse-γ conversion.

The coefficient setting section 6 applies a inverse conversion of conversion characteristics of the conversion table 3. In the present aspect, the conversion characteristics of the conversion table are represented by power of γ of an inputted value as illustrated in FIG. 13. Here the value γ is more than "1". Especially, the value γ is preferably substantially "1.8" through "3.0". Generally, the value such as 2.2 is used. The inverse conversion is represented by the γ-th power root. As a result, if a coefficient s7 to be set by the coefficient setting section 6 for the multiplier 2, K(t) is represented by following equation 2.

$$K(t)=\sqrt[\gamma]{G(t)} \qquad \text{[Equation 2]}$$

The multiplier 2 multiples K(t) by the digital image signal s2. An average brightness of display signals s4 to be displayed on the display device is refrained by a value being not more than the brightness reference value.

In the above-mentioned explanation, the frame characteristics value detecting section 4 detects an average value between display signals by each of frames. However, total summation of the display signals, the number of the display signals over a predetermined value, an average value or a total summation by each color, or a total summation or an average value of brightness component of each of color display signals or the like is detected and output the detected one to the gain calculating section 5. Also, the frame characteristics value detecting section 4 may be constituted in which a single screen is divided into plural areas to detect an average value or a total summation of each of the areas or in which an average value or a total summation regarding only center portion is detected.

As above-explained, according to the present aspect, the frame characteristics value is obtained from actual display signals, so that an accurate brightness evaluation value can be obtained and prompt convergence can be established. Thus even in a moving image whose average brightness degree is sequentially changed, a splendid ABL control can be performed.

(Total Configuration of Image Display Device)

Figure 2:
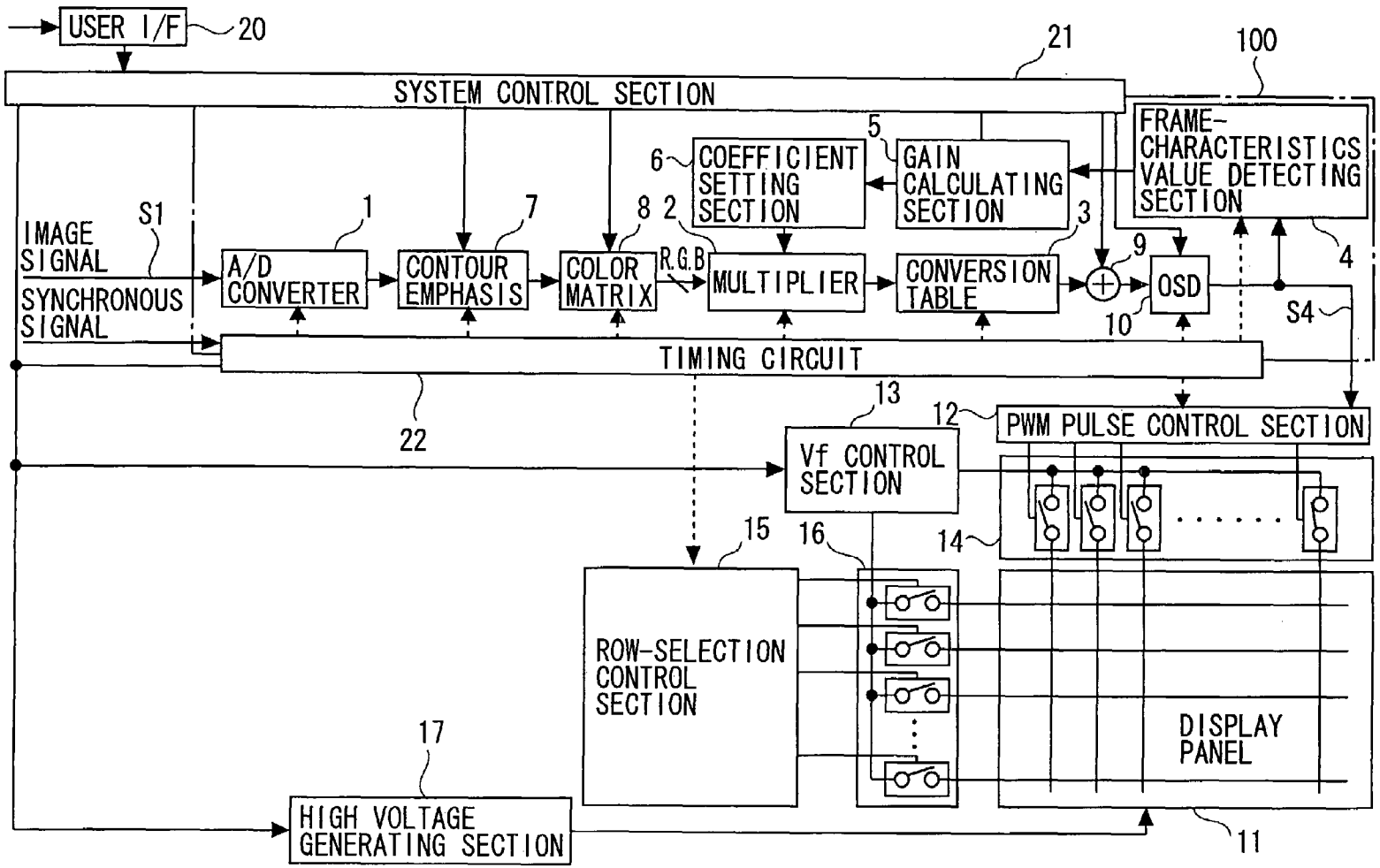
FIG. 2 is a block diagram for illustrating the configuration of the image display device of the present invention.

FIG. 2 shows a configuration of whole of the image display device relating to the aspect of the present invention. In FIG. 2, a part surrounded by a one-dotted line corresponds to the image signal processing device 100 explained in FIG. 1. FIG. 2 also shows a configuration being omitted in FIG. 1.

The image signal processing device 100 is provided with a contour emphasis circuit 7, a color matrix converting circuit 8, an adder 9, and a character information combining circuit 10 in addition to the configuration illustrated in FIG. 1.

The contour emphasis circuit 7 emphasizes an edge portion of the image formed by inputted image signals. The color matrix converting circuit 8 converts the input image signals into RGB signals when the input signals are brightness/color-difference signals. Note that the color matrix circuit 8 does not do convert the input image signals into RGB signals when the inputted image signals are RGB signals. The adder 9 adds an off-set value set by a system control section 21 to each of signals. The processing of the adder 9 is mainly used when brightness is adjusted and the like. The character information combining circuit 10 is generally called OSD (On Screen Display), in which character information and icon(s) are interposed over the image signals. The character information combining circuit 10 brings about visually strange feelings if brightness of characters/icons to be combined is changed by the ASL control and/or screen image quality adjustment. Accordingly, note that the circuit 10 is arranged at a stage after the multiplier 2 and the adder 8 not so as to be affected by them. Recently the size of information combined by the character information combining circuit 9 often arrives at a large area size, s6 that a ratio of the size of information combined by the character information occupied with relative to a whole display signal is becoming large. Thus the frame characteristics value detecting section 4 is arranged at a stage after the character information combining circuit 10.

The image display device is provided with a display panel 11, a PWM pulse control section 12, Vf control section 13, a column wiring switch section 14, a row selection control section 15, a row wiring switch section 16, a high voltage generating section 17, a user interface circuit 20, a system control section 21 and a timing control section 22 in addition to the image signal processing device 100.

In this example, an SED panel is used as the display panel 11 in which a multi electron source where e.g., a surface conduction type electron emission elements being arranged as cold-cathode elements; and phosphors being an image forming member for forming an image with irradiation of electrons; are mutually opposed in a thin type vacuum housing. In the display panel 11, the electron emission elements are wired in a normal matrix manner by row-direction wiring electrodes and column-direction wiring electrodes. Electrons to be emitted from elements selected by a column/row electrode bias are accelerated with a high voltage and the electrons are allowed to be collided with the phosphors resulting in obtaining emission of light. The configuration and manufacturing method of SED panel is disclosed in Japanese Patent Laid-open application No. 2000-250463 filed by the assignee as same as this application's assignee.

The PWM pulse control section 12 converts the display signals into drive signals adapted to the display panel 11. The Vf control section 13 controls a voltage that drives elements arranged in the display panel 11. The column wiring switch section 14 is constituted by switch means such as transistors, which applies a drive output from the Vf control section 13 to the panel column electrodes by each horizontal period (row selection term) for a term of PWM pulse to be outputted from the PWM pulse control section 12. The row selection control section 15 generates a row selection pulse that drives elements on the display panel 11. The row wiring switch section 16 is constituted by switch means such as transistors. A drive output from the Vf control section 13 corresponded to a row selection pulse to be outputted from the row selection control section 15 is outputted to the panel 11. The high voltage generating section 17 generates an accelerating voltage that is accelerated in order to allow electrons emitted from the electron emission element to be collided with phosphors.

The user interface circuit 20 inputs an image quality adjusting value to the system control section 21. The image quality includes contrast, brightness, and the like. The system control section 21 monitors and control a whole system and sets operation of each of blocks of the image signal processing device 100 corresponded to the image quality adjusting value to be inputted from the use interface circuit 20 and the inputted image signals. The timing control section 22 also outputs various timing signals for operation of each of blocks to circuits 12 to 16 that drive column wiring and row wiring and each of the blocks in the image signal processing device 100.

(Image Display Operation)

When a normal image display is operated, the inputted image signal s1 is inputted to the image signal processing device 100 and converted the inputted signal s1 into the display signal s4. The display signal s4 is converted in serial/parallel manner by a horizontal one period (row selection term) and PWM-modulated by each of columns. The PWM-modulated pulse is outputted to the column switch section 14.

The row selection control section 15 selects a row of the display panel 11 by outputting a selection pulse to the row wiring switch section 16 based on a signal such that a start pulse being made to be coincident with a starting point of a vertical effective display term is sequentially shifted by the row selection term.

Thus the display panel 11 is driven and an image is displayed thereon.

Note that when the input image signal is a digital image signal, the A/D converter 1 is unnecessary.

The present aspect has been explained with the case where the display device is the SED panel. However, the present aspect can be applied to the display device irrespective of any configuration of the display panel in itself such as FED, PDP or EL.

Also the present aspect has been explained about a case of digital signal processing. However, a function such as the function of digital signal processing may be realized using an analog circuit. In this case, the A/D converter 1 will be unnecessary, and each of processing circuits can be-activated using the analog circuit.

(Second Aspect)

Figure 3:
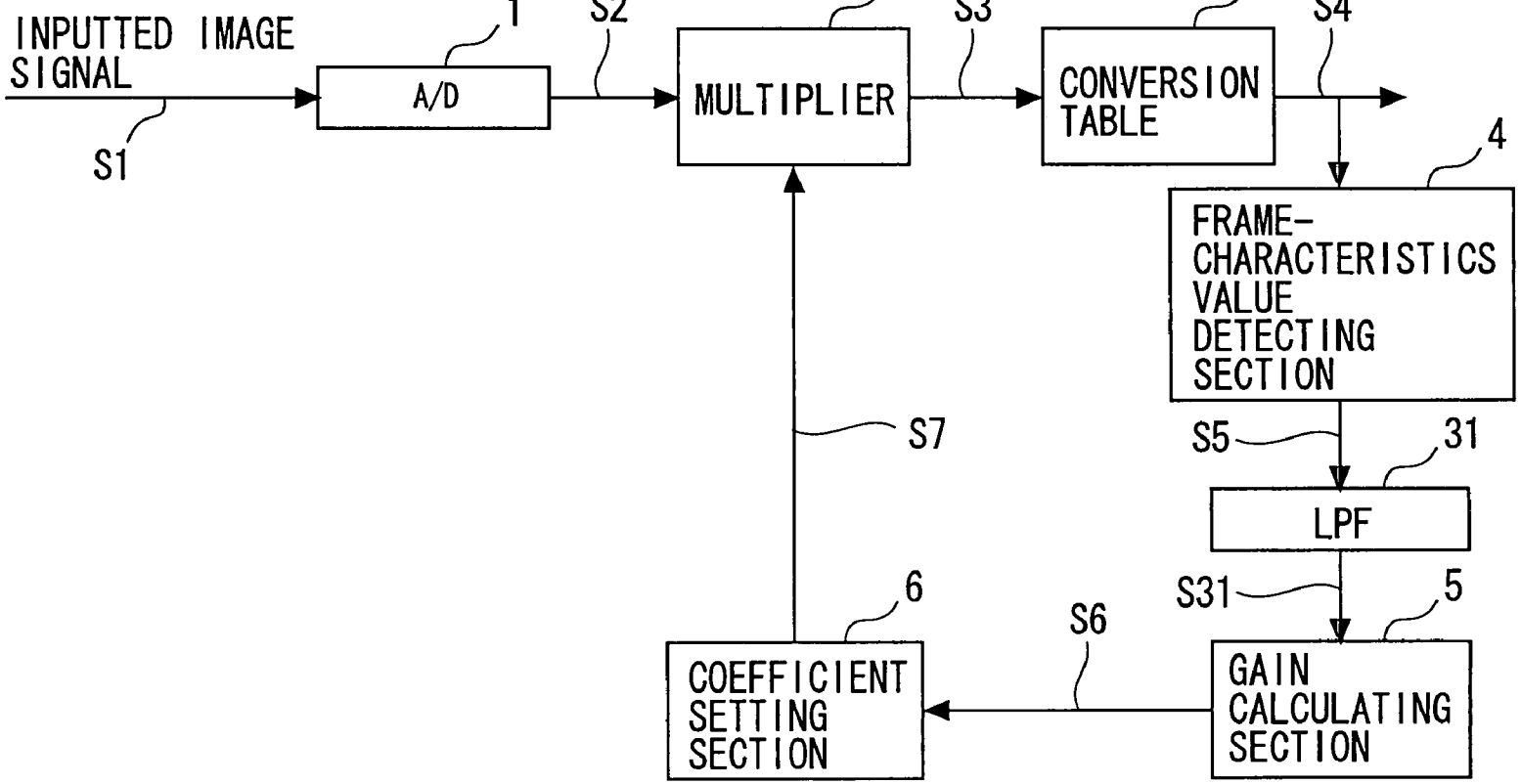
FIG. 3 is a block diagram for explaining about the configuration of the second aspect of the invention.

FIG. 3 illustrates an image signal processing device that is applied to the image display device-relating to the second aspect of the present invention. A configuration except for the image signal processing device 100 of the whole image display device in FIG. 3 is as same as that in FIG. 2. The same numerals are labeled for the same configuration parts in FIG. 1 and FIG. 3. Also the explanation for them is omitted here.

In the first aspect, the output of the frame characteristic value detecting section 44 is inputted to the gain calculating section 5. However, in the present aspect, an average brightness signal s5 is inputted to a LPF (Low Pass Filter) 31. The output s31 is inputted to the gain calculating section 5. Here the LPF 31 and the gain calculating section 5 constitute a brightness refrain value output circuit.

The LPF 31 cuts a high frequency component of the average brightness signal s5 and refrains changing of the gain s6 owing to-minute changing by each of frames of an inputted image, resulting in that a visual hindrance feeling will be prevented.

Likewise in the present aspect, the above-mentioned effect is realized using a configuration of combination of the image signal processing device 100 and the LPF 31. However, even if the configuration of FIG. 1 is used, through processing of the gain calculating section 5, by using following equation 3 in place of the equation 1, a result can be obtained, which is substantially equal to the result obtained through the image signal processing device illustrated in FIG. 3.

$$G(t)=\mathrm{MIN}(G(t-1)\times B_0/f(B).1) \qquad \text{[Equation 3]}$$

Here, f(x) is a function being substantially equal to a function of characteristics of the LPF 31, in which an average brightness of already-obtained plural frames is regarded as input data and thereafter output data is obtained after filtering.

(Third Aspect)

Figure 4:
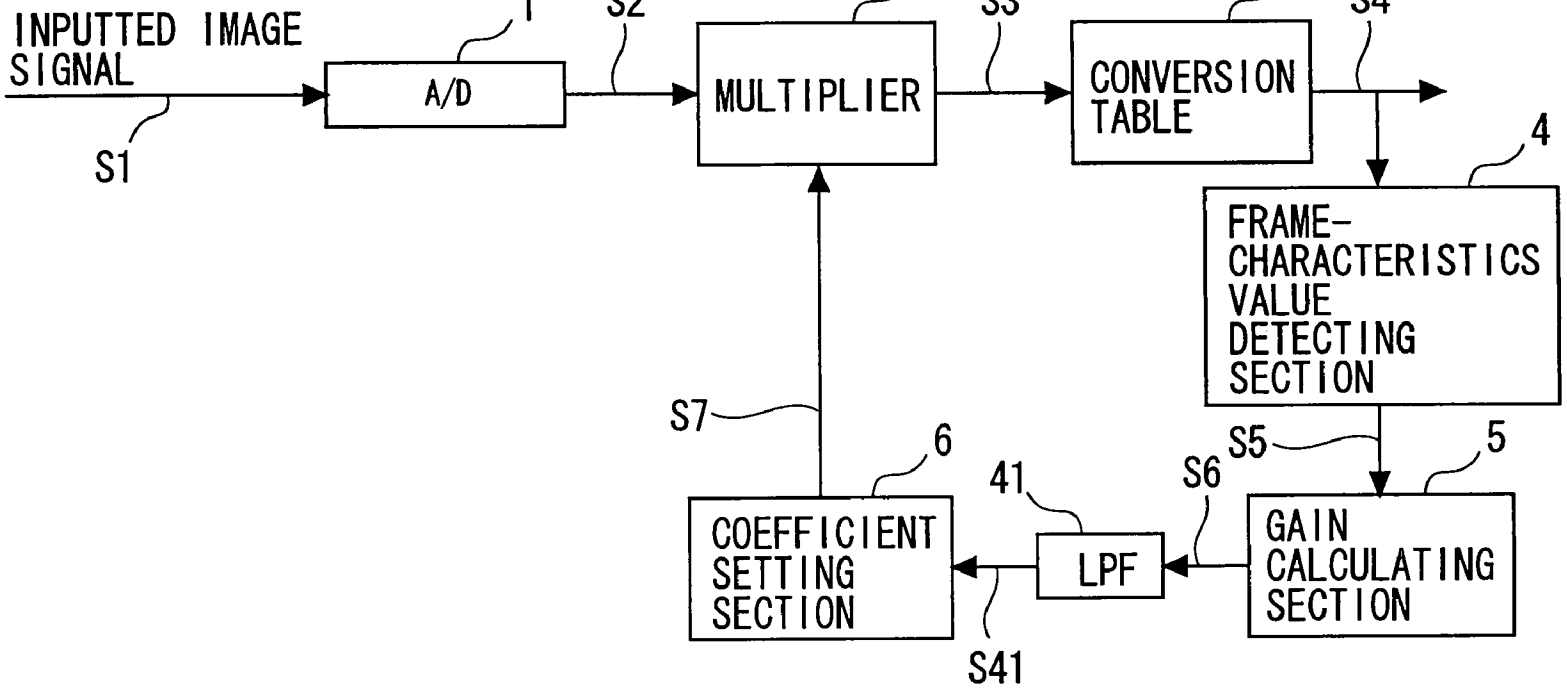
FIG. 4 is a block diagram for explaining about the configuration of the third aspect of the invention.

FIG. 4 illustrates a configuration of an image signal processing device that is applied to the image display device relating to the third aspect. A configuration except for the image signal processing device 100 of the whole image display device in FIG. 3 is as same as that in FIG. 2. The same numerals are labeled for the same configuration parts in FIG. 1 and FIG. 3. Also the explanation for them is omitted here.

In the first aspect, the output of the gain calculating section 5 is inputted to the coefficient setting section 6. However, the gain s6 is inputted to the LPF 41 and thereafter the output s41 is inputted to the coefficient setting section 6. Here the LPF 41 and the coefficient setting section 6 constitute an adjusting value output circuit.

Likewise, in the present aspect, the above-mentioned effect is realized using a configuration of combination of the image signal processing device 100 and the LPF 41. However, even if the configuration of FIG. 1 is used, through processing of the gain calculating section 5, by using following equation 4 in place of the equation 1, a result can be obtained, which is substantially equal to the result obtained through the image signal processing device illustrated in FIG. 4.

$$G(t)=\mathrm{MIN}(G'(t-1)\times B_0/B(t).1) \qquad \text{[Equation 4]}$$

Here, G'(t)=f'(G) and f'(x) is a function being substantially equal to a function of characteristics of the LPF 41, in which an average brightness of already-obtained plural frames is regarded as input data and thereafter output data is obtained after filtering. G'(t) is outputted to the coefficient setting section 6.

(Fourth Aspect)

Figure 5:
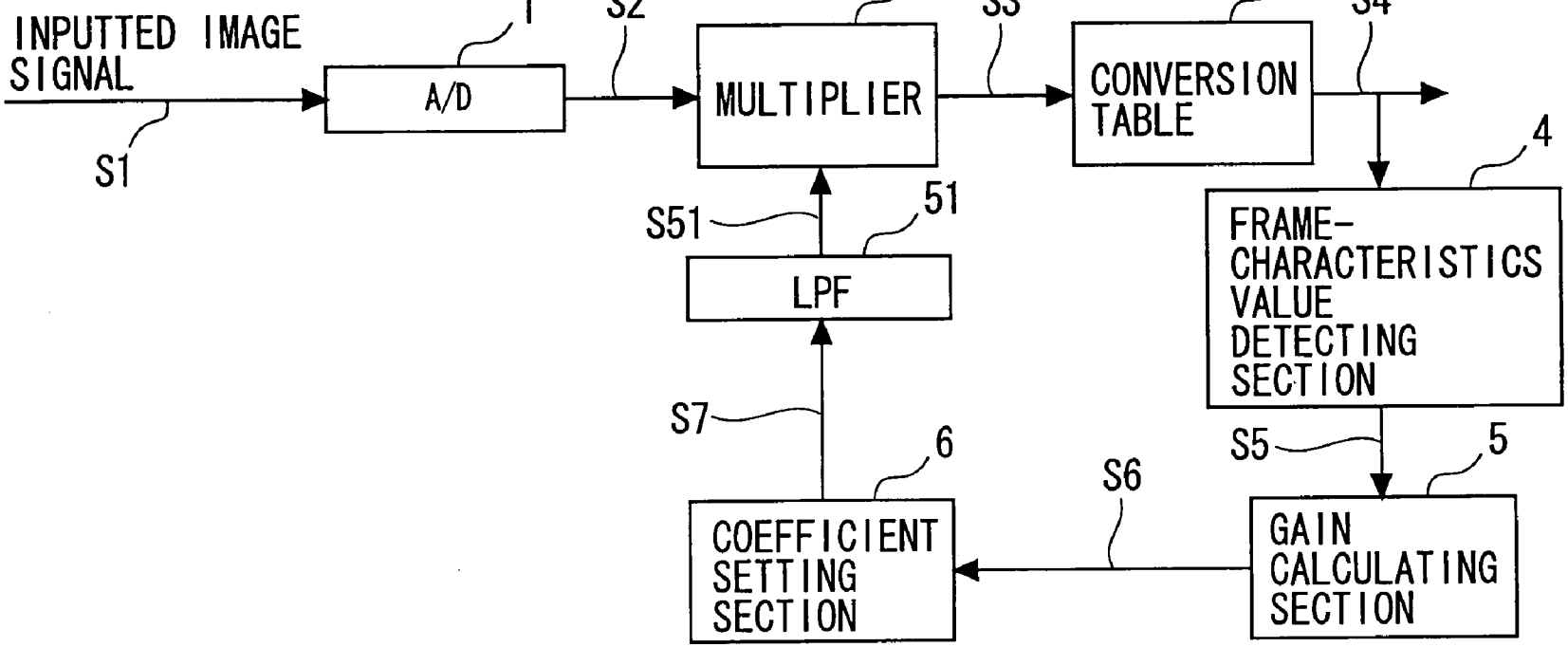
FIG. 5 is a block diagram for explaining about the configuration of the fourth aspect of the invention.

FIG. 5 illustrates a configuration of an image signal processing device that is applied to the image display device relating to the fourth aspect. A configuration except for the image signal processing device 100 of the whole image display device in FIG. 5 is as same as that in FIG. 2. The same numerals are labeled for the same configuration parts in FIG. 1 and FIG. 5. Also the explanation for them is omitted here.

In the first aspect, the output of the coefficient setting section 6 is inputted to the multiplier 2. However, here the gain s7 is inputted to the LPF 51 and thereafter the output s51 is inputted to the multiplier 2. Here the LPF 51 and the multiplier 2 constitute an adjusting circuit.

The LPF 51 cuts a high frequency component of the coefficient s7 and refrains affection owing to minute changing by each of frames of input image, resulting in that visual hindrance feeling is prevented.

Likewise, in the present aspect, the above-mentioned effect is realized using a configuration of combination of the image signal processing device 100 and the LPF 51. However, even if the configuration of FIG. 1 is used, through processing of the gain calculating section 5, by using following equation 5 in place of the equation 1, a result can be obtained, which is substantially equal to the result obtained through the image signal processing device illustrated in FIG. 5.

$$G(t)=\mathrm{MIN}((K'(t-1))^{\gamma}\times B_0/B(t).1)$$

$$K(t)=\sqrt[\gamma]{G(t)} \qquad \text{[Equation 5]}$$

Here, K'(t)=f'' (K) and f'' (x) is a function being substantially equal to a function of characteristics of the LPF 51, in which a coefficient K of each of already-obtained plural frames is regarded as input data and thereafter output data is obtained after filtering. K(t) is outputted to the multiplier 2.

(Fifth Aspect)

Figure 6:
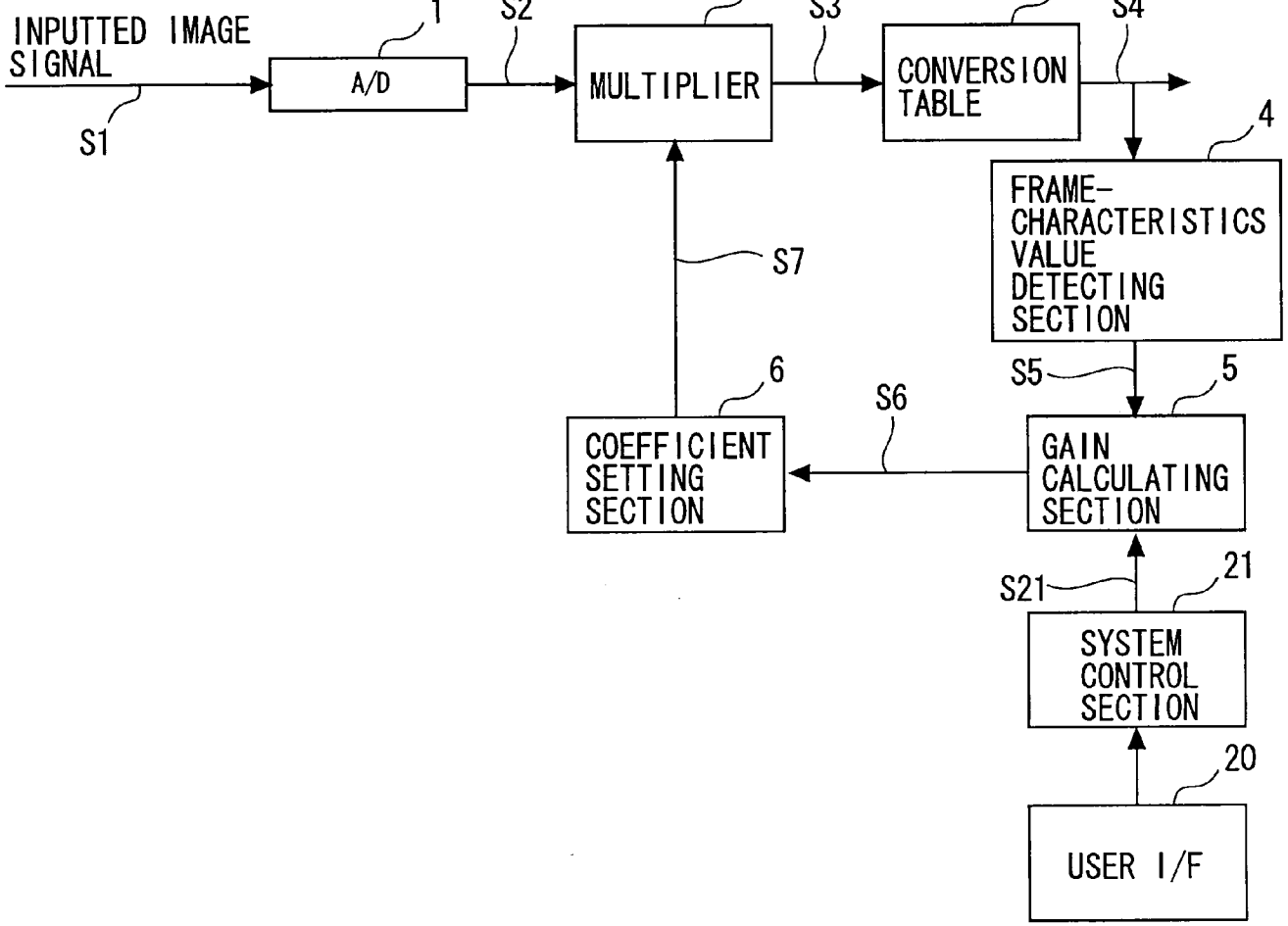
FIG. 6 is a block diagram for explaining about the configuration of the fifth aspect of the invention.

FIG. 6 illustrates a block diagram that picks up a configuration of an image display device relating to the fifth aspect of the present invention. A configuration of the whole image display device in FIG. 6 is as same as that in FIG. 2. The same numerals are labeled for the same configuration parts in FIG. 1 and FIG. 2. Also the explanation for them is omitted here.

In the present aspect, a contrast adjusting signal s21 is inputted to the gain calculating section 5 in addition to an average brightness signal s5. The contrast adjusting signal s21 as a brightness control value relating to an image quality adjustment is set using a user interface 20, normalized using a system control section 21 and the like to be applied to the gain calculating section 5.

The gain calculating section 5 outputs a smaller value of a value represented by the gain G(t) obtained using the equation (1) and a value represented by the contrast adjusting signal s21. Alternatively the gain calculating section 5 multiplies the gain G by the contrast adjusting signal s21.

In the present aspect, the contrast adjusting signal s21 is inputted to the gain calculating section 5. However, the signal s21 may be inputted to,the coefficient setting section 6. In this case, the coefficient setting section 6 sets, as a coefficient s7 to be set into the multiplier 2, a smaller value of a value obtained by applying inverse conversion of conversion characteristics of the conversion 3 to the gain s6 and a value owing to the contrast adjusting signal s21 or a result of multiplication of them.

(Sixth Aspect)

Figure 7:
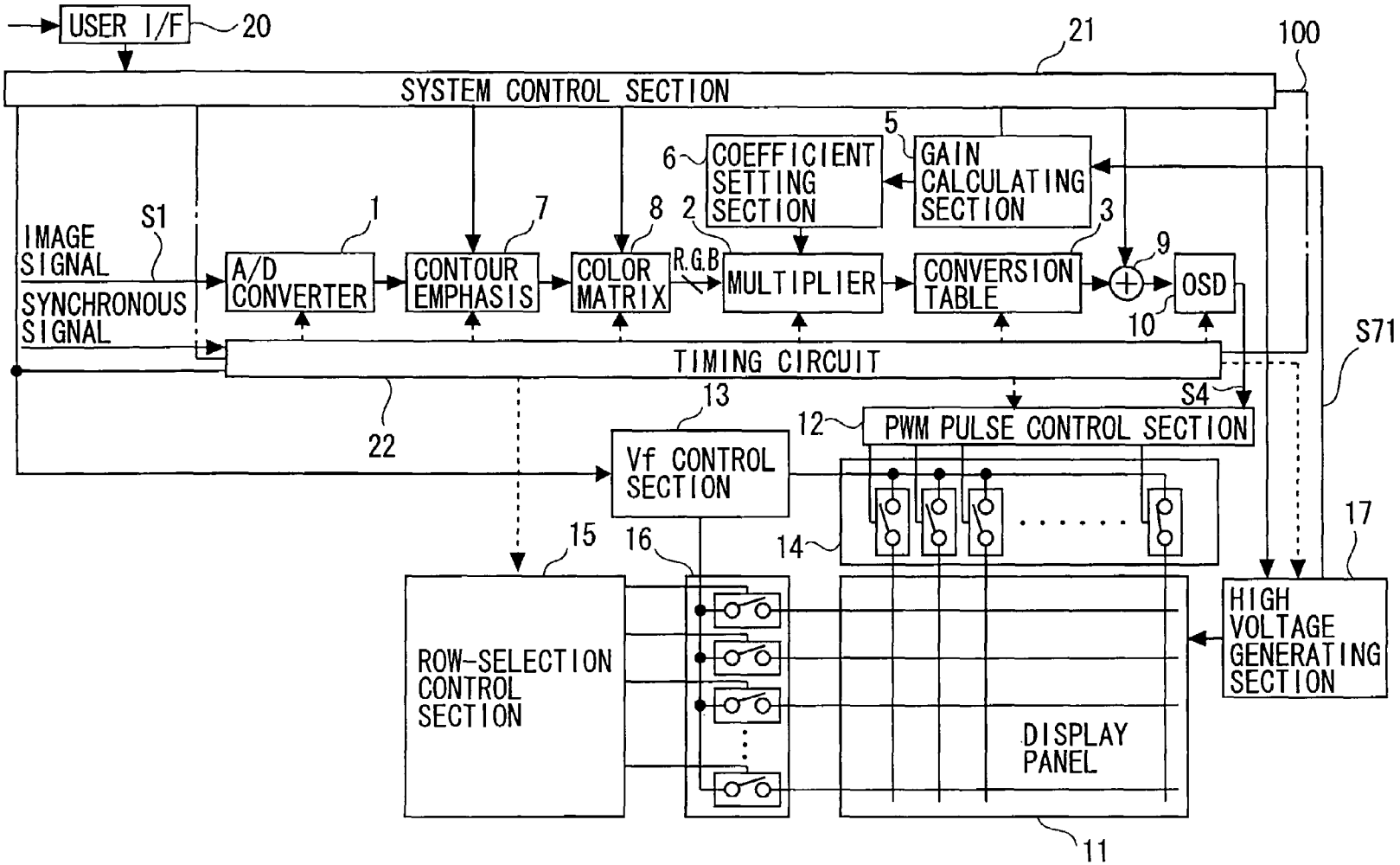
FIG. 7 is a block diagram for explaining about the configuration of the sixth aspect of the invention.

FIG. 7 illustrates a configuration of an image display device relating to the sixth aspect of the present invention. Regarding as a configuration of the whole image display device in FIG. 7 as same as that in FIGS. 1 and 2, the same numerals are labeled for the same configuration parts in FIGS. 1 and 2.

In the above-mentioned aspect, the configuration has been disclosed in which regarding as a static value for a predetermined term, the average brightness for a single frame term is used as the display brightness characteristics value. However, in the present aspect, the high voltage generating section 17 also serves as the display brightness characteristics value detecting circuit that outputs a high voltage current value signal s71 as the display brightness characteristics value. Namely, in place of the average brightness signal s5 in the above-mentioned aspect, a high voltage current value signal s71 obtained from the high voltage generating section 17 as the display brightness characteristics value is inputted to the gain calculating section 5. In a case of an SED panel, a high voltage current is increased or decreased substantially in proportion to an amount of luminescence, so that the current can be preferably used as a measure of the average brightness being directed to an emission current value to be emitted from an electron emission element. Processing after the processing of the gain calculating section 5 is as same as processing of the first aspect. Also the static value of the high voltage current value for a predetermined term may be outputted to the gain calculating section 5 as a display brightness characteristics value.

According to the present aspect, an actual high voltage current is used as a measure of an average brightness, so that an accurate brightness evaluation value can be obtained and a prompt convergence can be performed, resulting in that a splendid ABL control can be attained even for a moving image in which an average brightness is sequentially changed.

(Seventh Aspect)

In the first aspect, the power of γ is used as the conversion characteristics of the conversion table 3. However, as a function g(x) that defines an inverse-γ of the conversion table 3, a function is used that consists of a linear part corresponded to a low gradation and a power-of-number part corresponded to a high gradation. Concretely, the function is defined by following equation 6.

$$g(x)=a*x(x\leq x_0),$$

$$g(x)=(1-z)x^{\gamma}+z(x>x_0) \quad \text{[Equation 6]}$$

Here, γ, a, z and x0 are constant. The x0 is directed to a connection point between the two above equations. In a case of x=x0, γ, a, z and x0 are defined by values obtained by two above equations and a differential value are equal. In the present aspect, it is defined by following;

$$\gamma=2.2,\ a=1/16,\ z=0.001856 \text{ and } Xo=0.0515. \quad \text{[Equation 7]}$$

Figure 8A:
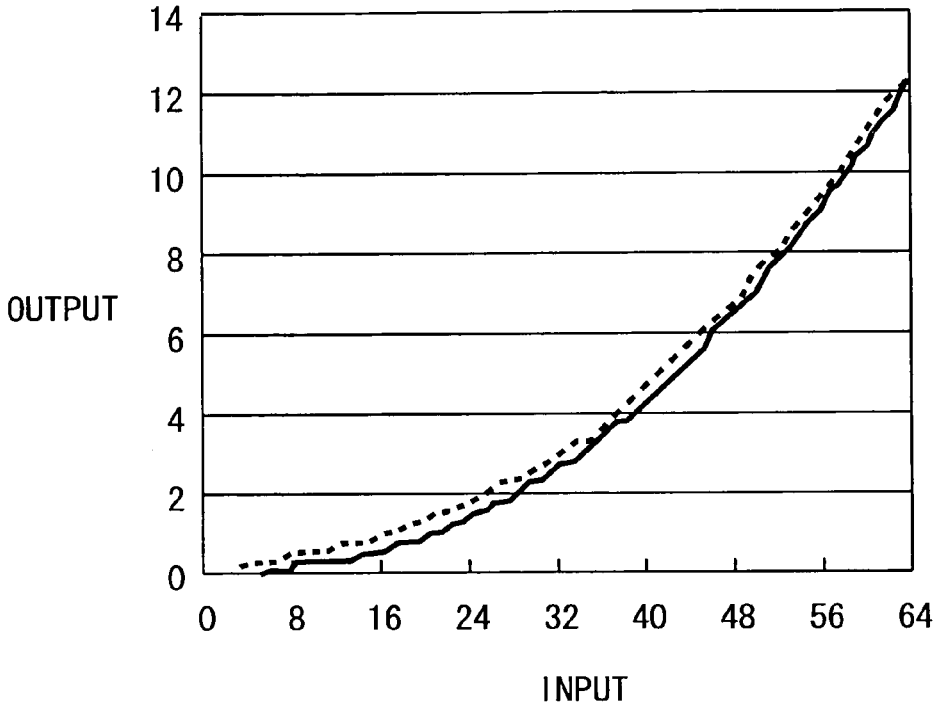
FIG. 8A and FIG. 8B are graphs for explaining about collapse of black color at a lower gradation by the inverse-γ conversion.
Figure 8B:
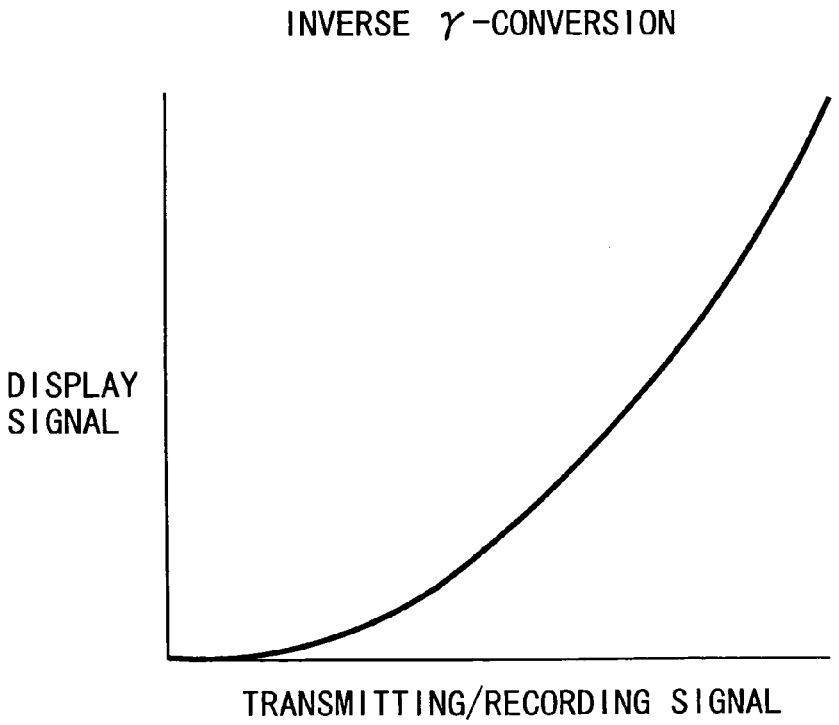

If this function is used, then collapse of black color at a gradation portion can be more reduced than that in a case of using a function of power of 2.2 as illustrated in FIG. 8A. FIG. 8A merely shows a low gradation portion, defining an input by 8 bit (0 to 255) and defining an output by 10 bit (0 to 255 that is divided by 0.25 unit). A continuous line is directed to a function of power of 2.2 and a dotted line is directed to the equation 6 and the equation 7.

The coefficient setting section 6 applies inverse conversion of conversion characteristics of the conversion table 3 to the gain s6. However, the functions by the equations 6 and 7 has a shape very similar to a shape of the function of power of 2.2 as a whole, so that processing represented by the equation 2, namely processing represented using the 2.2-th power root has only to be performed in a way as same as the first aspect.

Figure 9:
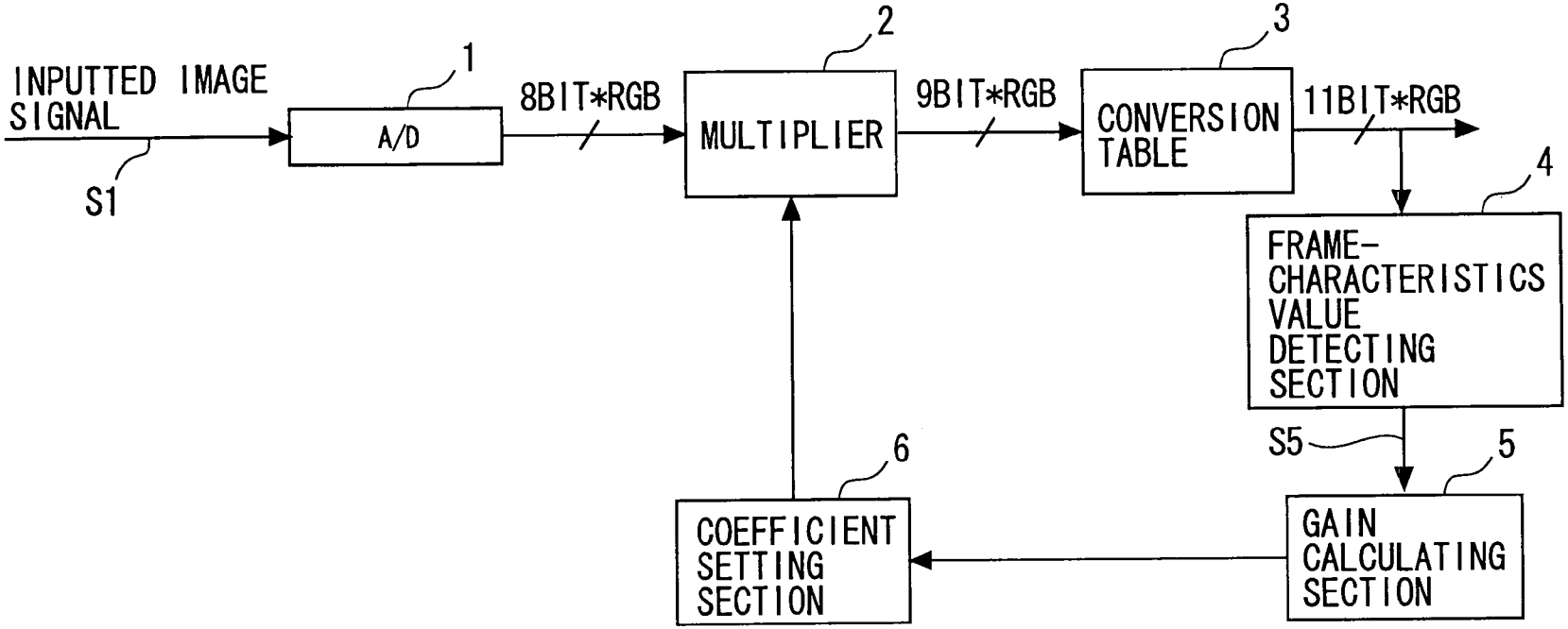
FIG. 9 is a block diagram for explaining about a scale of the circuit of the sixth aspect of the invention.

FIG. 9 is a block diagram for illustrating a bit width to be required when the equations 6 and 7 are used as a conversion function of the conversion table 3 of the image signal processing device that is applied to an image display device relating to the present aspect. Here, a brightness reference value of the ABL control is a value obtained by dividing the maximum brightness by 4. As an assumption, an input image has a part of a low gradation over a whole light screen, focusing on collapse of black color at a low gradation portion when the ABL control is operated.

If a bit width of output of the A/D converter 1 is defined by 8 bit by each of colors, a coefficient to be multiplied using the multiplier 2 is the 2.2-th power root of ¼ as above-mentioned, resulting in substantially ½. Accordingly, in order to lose a resolution capability of the A/D converter 1, 9 bits by each of colors are required for the bit width of output of the multiplier 2. A bit width in order to obtain expression capability of the low gradation section being substantially equal to the expression capability represented by a dotted line using the conversion table 3 is directed to 11 bits.

Figure 10:
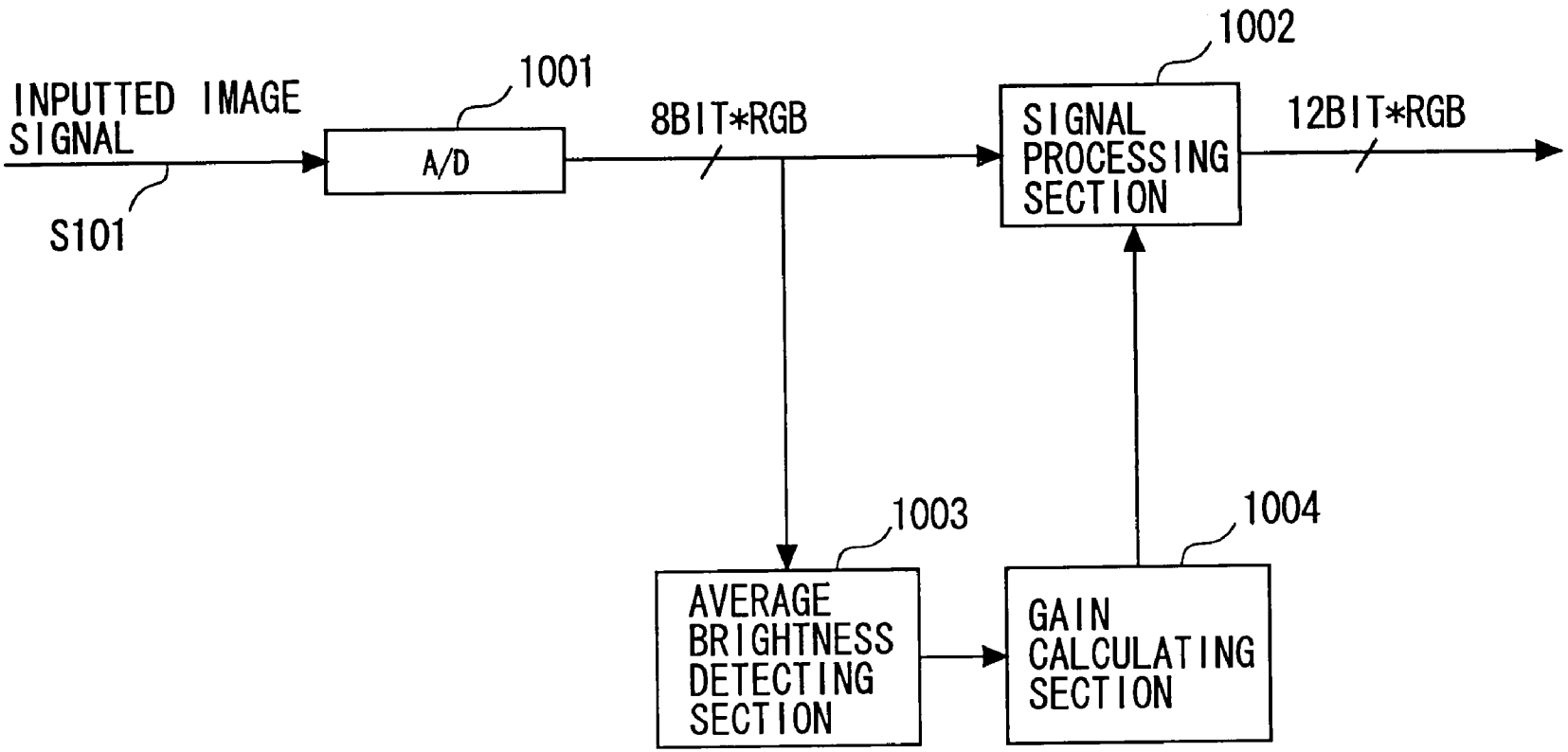
FIG. 10 is a block diagram for explaining about a scale of the circuit of FIG. 14.
Figure 12:
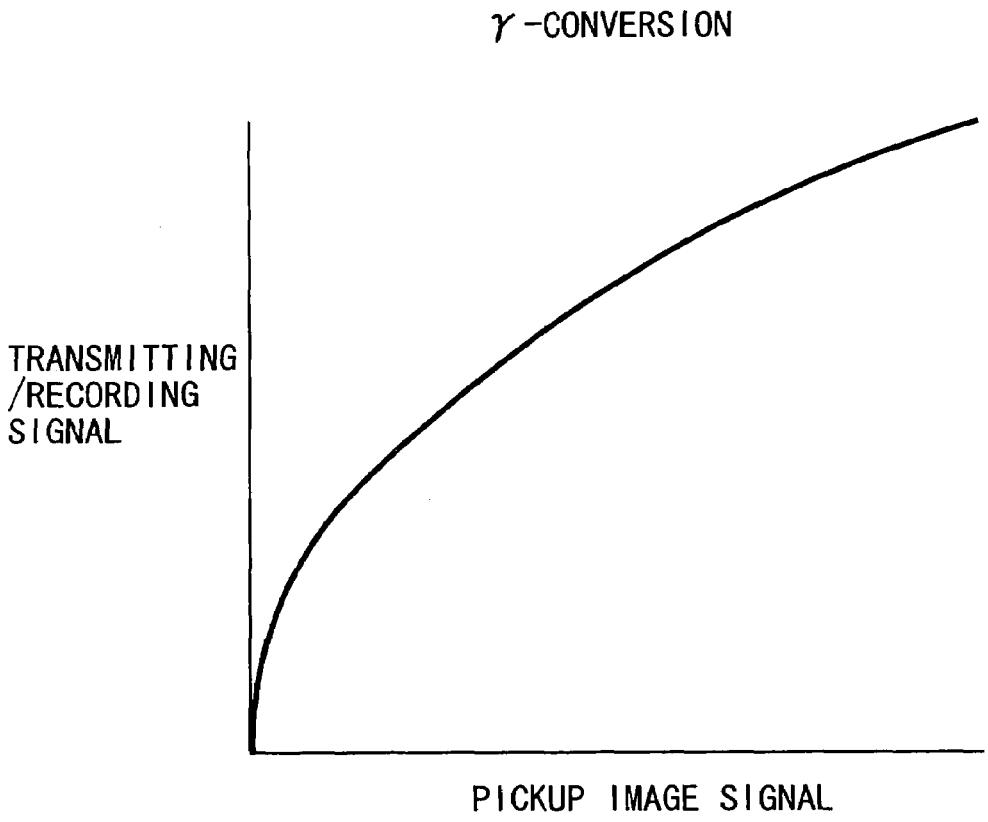
FIG. 12 is a graph for explaining about the γ conversion.
Figure 14:
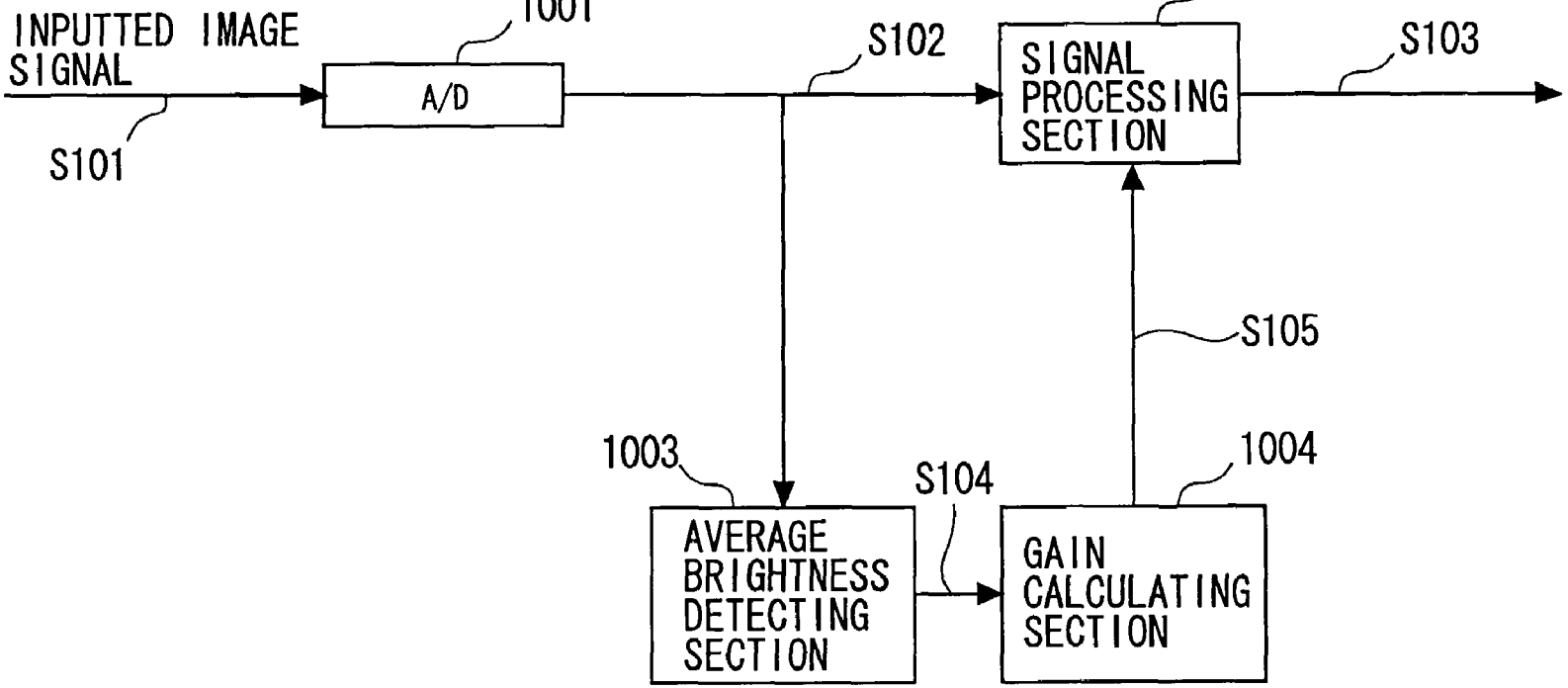
FIG. 14 is a block diagram of a normal image signal processing device.

On the contrary to FIG. 14, FIG. 10 illustrates a block diagram into which bit widths are written as above-mentioned. If a bit width of output of the A/D converter 1001 is defined by 8 bits for each of colors, a bit width becomes input data+2 bits in order to obtain expression capability being substantially equal to capability represented by the dotted line in FIG. 8A when the signal processing section 1002 performs γ-conversion. Furthermore, if multiplied by the ABL control value ¼, 2 bits are additionally required, so that the output bit width becomes 12 bits for each of colors.

FIG. 11 is a table in which values of bit widths are arranged in order to obtain expression capability at a low gradation part when calculation of the power of 2.2, the equation 6 and the equation 7 are applied to each of the configurations are applied to the conventional configuration (FIG. 14) and the present aspect configuration (FIG. 1), in order to obtain expression capability being substantially equal to capability represented by the dotted line in FIG. 8A, namely in order not to collapse 8 bits input gradation.

In short, by using the present aspect configuration and further by using the equation 6 as a function of an -γ conversion, only with fewer numbers of bits of image signal processing, an expression capability at a low gradation part can be obtained which is substantially as same as the expression capability represented by the dotted line in FIG. 8A.

Such an effect is not limited to a case where the equation 6 is used as a function g(x) of the inverse-γ conversion characteristics Namely, such an effect can be also obtained using a function being near the function of the power of γ as a whole such that output becomes larger than a function of the power of γ especially at a low gradation section.

As above-explained, according to each of the aspects of the present invention, accurate average brightness information can be obtained and an image display that can realize a splendid ABL control can be attained.

Also, by using a function being near the function of the power of γ as a whole such that output becomes larger than a function of the power of γ especially at a low gradation section, without deteriorating expression capability at a low gradation part, a circuit scale can also become smaller.

According to the present invention, an accurate image signal can be adjusted in a configuration in which non-linear conversion is performed.

What is claimed is:

1. An image display device comprising:

an adjusting circuit that adjusts inputted image signals based on an adjusting value to be sequentially up-to-dated;

a non-linear converting circuit at a stage after said adjusting circuit, said non-linear converting circuit that converts inputted signals into signals in a non-linear manner;

a display brightness characteristics value detecting circuit at a stage after said non-linear converting circuit, said display brightness characteristics value detecting circuit that sequentially detects a display brightness characteristics value indicating lightness of a display image from inputted signals;

a brightness refraining value outputting circuit that sequentially outputs a brightness refraining value that refrains lightness of said display image based on said display brightness characteristics value; and an adjusting value outputting circuit that applies a conversion having characteristics being inverse with relative to a converting characteristics of said non-linear converting circuit or conversion having characteristics approximate to the inverse characteristics, to said brightness refraining value to output said adjusting value.

2. The image display device according to claim 1, wherein said display brightness characteristics value is a total sum or an average value of display signals for a predetermined term.

3. The image display device according to claim 1, wherein said display brightness characteristics value is the number of signals over a predetermined value of display signals for a predetermined term.

4. The image display device according to claim 1, wherein said display brightness characteristics value is a total sum or an average value of kinds of colors of display signals for a predetermined term.

5. The image display device according to claim 1, wherein said display brightness characteristics value is a total sum or an average value of brightness components of display signals for a predetermined term.

6. The image display device according to claim 1, wherein said display brightness characteristics value is a static value of display signals in a specified area in a screen.

7. The image display device according to claim 1, wherein conversion characteristics of said non-linear converting circuit is a function having characteristics so as to be approximate to characteristics of equation of $g(x)=x^{\gamma}$ (x: inputted signal, g(x): output signal) over all the inputted area and a function having characteristics so that an output becomes larger than a value obtained by the equation of $g(x)=x^{\gamma}$ in a lower gradation section.

8. The image display device according to claim 7, wherein conversion characteristics of said non-linear converting circuit is represented by equations of:

$$g(x)=a*x(x\leq x0),$$

$$g(x)=(1-z)x^{\gamma}+z(x>x0)$$

(x: inputted signal, g(x): output signal, a, z, γ and x0: constant values).

9. The image display device according to claim 7, wherein said adjusting value is the γ-th power root to said brightness refraining value.

10. The image display device according to claim 1 further comprising a character information combining circuit for overlapping character information over said image signal, wherein said adjusting circuit, said non-linear converting circuit, said character information combining circuit and said display brightness characteristics detecting circuit are arranged orderly.

11. The image display device according to claim 1, wherein pixels of said image display device are constituted by electron emission elements arranged in a matrix manner.

12. The image display device according to claim 11, wherein said electron emission elements are surface conduction type electron emission elements.

13. The image display device according to claim 12, wherein said display brightness characteristics value is an emitted current value to be emitted from said electron emission elements.

14. An image display device comprising:

a multiplying circuit that outputs output signals obtained by multiplying inputted signals and a variable coefficient;

a non-linear converting circuit at a stage after said multiplying circuit, said non-linear converting circuit that applies a non-linear conversion of power of γ (γ>1) or a conversion being approximate to the non-linear conversion of power of γ (γ>1) to inputted signals and outputs the converted signals; and a display brightness characteristics value detecting circuit at a stage after said non-linear converting circuit, said display brightness characteristics value detecting circuit that detects a display brightness characteristics value indicating lightness of display image from inputted signal;

wherein at first value which is the γ-th power root to a calculated value G that is sequentially up-to-dated or a second value approximate to the first value is used as said variable coefficient, and regarding as said calculated value G, if said display brightness characteristics value is defined by B, a calculated value before updating is defined by G0, and a reference value that is compared with said display brightness characteristics value is defined by B0, then a relation of G=G0×B0/B is satisfied.

15. The image display device according to claim 14, wherein if said value of G0×B0/B is more than 1, then 1 is set as said calculated value G.

16. An image display device comprising:

a multiplying circuit that outputs output signals obtained by multiplying inputted signals and a variable coefficient;

a non-linear converting circuit at a stage after said multiplying circuit, said non-linear converting circuit that applies a non-linear conversion of power of γ (γ>1) or a conversion being approximate to the non-linear conversion of power of γ (γ>1) to inputted signals and outputs the converted signals; and a display brightness characteristics value detecting circuit at a stage after said non-linear converting circuit, said display brightness characteristics value detecting circuit that detects a display brightness characteristics value indicating lightness of display image from inputted signal, wherein said variable coefficient is a first value which is the γ-th power root to a calculated value G that is sequentially up-to-dated or a second value being approximate to the first value, or a value obtained by modifying a high frequency component of a first value which is the γ-th power root of the calculated value G that is sequentially up-to-dated or the second value being approximate to the first value, and wherein said calculated value G is any of (i) said display brightness characteristics value, or (ii) a value of G0×B0/B if a value obtained by modifying a high frequency component of a plurality of said display brightness characteristics value that is sequentially detected from the input signals is defined by B and a calculated value before updating is defined by G0 and a reference value that is compared with said display brightness characteristics value is defined by B0 or (iii) a value obtained by modifying a high frequency component of G0×B0/B to be sequentially obtained or (iv) a value of $K0^{\gamma}\times B0/B$ if a variable coefficient before updating is defined by K0.

17. The image display device according to claim 16, wherein 1 is set as said calculated value G if a value used as said calculated value G, among (i) said value of G0×B0/B, (ii) said value obtained by modifying a high frequency component of G0×B0/B to be sequentially obtained and (iii) said value of $K0^{\gamma}\times B0/B$ is more than 1 if the variable coefficient before updating is defined by K0.

18. An image display device comprising:

an adjusting circuit that adjusts inputted image signals based on an adjusting value to be sequentially up-to-dated;

a non-linear converting circuit at a stage after said adjusting circuit, said non-linear converting circuit that converts inputted signals into signals in a non-linear manner;

a display brightness characteristics value detecting circuit at a stage after said non-linear converting circuit, said display brightness characteristics value detecting circuit that sequentially detects a display brightness characteristics value indicating lightness of display image from inputted signals;

a brightness refraining value outputting circuit that sequentially outputs a brightness refraining value that refrains said lightness of said display image based on the display brightness characteristic value and a brightness control value related to an image quality adjustment; and an adjusting value outputting circuit that applies a first conversion having characteristic being inversed with relative to conversion characteristics of said non-linear converting circuit or a conversion having characteristics being approximate to the first conversion to said brightness refraining value to output said adjusting value.

19. An image display device comprising;

an adjusting circuit that adjusts inputted image signals based on an adjusting value to be sequentially up-to-dated;

a non-linear converting circuit at a stage after said adjusting circuit, said non-linear converting circuit that converts inputted signals into signals in a non-linear manner;

a display brightness characteristics value detecting circuit at a stage after said non-linear converting circuit, said display brightness characteristics value detecting circuit that sequentially detects a display brightness characteristics value indicating lightness of display image from inputted signals;

a brightness refraining value outputting circuit that sequentially outputs a brightness refraining value that refrains said lightness of said display image based on the display brightness characteristic value; and an adjusting value outputting circuit that outputs said adjusting value based on (i) a value obtained by applying a first conversion having characteristic being inversed with relative to conversion characteristics of said non-linear converting circuit or a conversion having characteristic being approximate to the inverse characteristics to said brightness refraining value, and (ii) a brightness control value relating to an image quality adjustment.

* * * * *

UNITED STATES PATENT AND TRADEMARK OFFICE

CERTIFICATE OF CORRECTION

PATENT NO. : 7,242,377 B2
APPLICATION NO. : 10/787084
DATED : July 10, 2007
INVENTOR(S) : Makiko Mori It is certified that error appears in the above-identified patent and that said Letters Patent is hereby corrected as shown below:

IN THE DRAWINGS:
Sheet 11, Fig. 11, “CONFIGULATION” (both instances) should read --CONFIGURATION--.

COLUMN 2:
Line 44, “value” should read --value.--.

COLUMN 3:
Line 28, “invention” should read --invention.--.
Line 49, “display.” should read --display--.

COLUMN 5:
Line 15, “seven” should read --seventh--.
Line 20, “seven” should read --seventh--.
Line 25, “seven” should read --seventh--.
Line 48, “0” should read --x0--.

COLUMN 7:
Line 28, “memories” should read --memories.--.
Line 31, “is as” should read --is the--.

COLUMN 8:
Line 4, “a” should read --an--.
Line 44, “whole” should read --the whole--.
Lien 60, “do convert” should read --convert--.

COLUMN 9:
Line 3, “ASL” should read --ABL--.
Line 6, “not so as” should read --so as not--.
Line 8, “s6” should read --so--.

COLUMN 10:
Line 31, “be-acti-” should read --be acti- --.
Line 36, “device-relating” should read --device relating--.
Line 39, “is as” should read --is the--.
Line 52, “to-minute” should read --to minute--.

UNITED STATES PATENT AND TRADEMARK OFFICE

CERTIFICATE OF CORRECTION

PATENT NO. : 7,242,377 B2
APPLICATION NO. : 10/787084
DATED : July 10, 2007
INVENTOR(S) : Makiko Mori It is certified that error appears in the above-identified patent and that said Letters Patent is hereby corrected as shown below:

COLUMN 11:
Line 9, “is as” should read --is the--.
Line 42, “is as” should read --is the--.

COLUMN 12:
Line 10, “is as” should read --is the--.
Line 29, “to,the” should read --to the--.
Line 63, “is as” should read --is the--.

COLUMN 13:
Line 25, “following;” should read --the following equation 7:--.

COLUMN 14:
Line 27, “characteristics” should read --characteristics.--.

COLUMN 18:
Line 1, “comprising;” should read --comprising:--.

Signed and Sealed this

Twenty-fifth Day of March, 2008

JON W. DUDAS
*Director of the United States Patent and Trademark Office*